US008056462B1

(12) United States Patent
Lacy et al.

(10) Patent No.: US 8,056,462 B1
(45) Date of Patent: Nov. 15, 2011

(54) SEQUENTIAL INJECTION GAS GUNS FOR ACCELERATING PROJECTILES

(75) Inventors: Jeffrey M. Lacy, Idaho Falls, ID (US); Henry S. Chu, Idaho Falls, ID (US); Stephen R. Novascone, Idaho Falls, ID (US)

(73) Assignee: Battelle Energy Alliance, LLC, Idaho Falls, ID (US)

( * ) Notice: Subject to any disclaimer, the term of this patent is extended or adjusted under 35 U.S.C. 154(b) by 423 days.

(21) Appl. No.: 12/269,972

(22) Filed: Nov. 13, 2008

(51) Int. Cl.
*F41F 1/00* (2006.01)

(52) U.S. Cl. ..... 89/8; 124/73

(58) Field of Classification Search ..... 89/7, 8, 89/1.809, 1.81; 124/71, 73
See application file for complete search history.

(56) References Cited

U.S. PATENT DOCUMENTS 3,914,996 A * 10/1975 Davis et al. ..... 73/167
3,940,981 A 3/1976 Covey et al.
4,590,842 A 5/1986 Goldstein et al.
4,658,699 A 4/1987 Dahm
5,063,826 A * 11/1991 Bulman ..... 89/8
7,775,148 B1 * 8/2010 McDermott ..... 89/8
2004/0107826 A1 6/2004 Simmons
2010/0212481 A1 * 8/2010 Koth ..... 89/7

OTHER PUBLICATIONS

Glenn, Lewis A., "Optimization Studies of a Three-Stage Light Gas Gun," American Physical Society, Topical Conference on Shock Compression of Condensed Matter, Amherst, MA Jul. 27-Aug. 1, 1997, 8 pages.
Linhart et al., "Theory of a multistage light gas gun," Acta Astronautica 61 (2007) 617-625.

* cited by examiner

*Primary Examiner* — Gabriel Klein
(74) *Attorney, Agent, or Firm* — TraskBritt

(57) ABSTRACT

Gas guns and methods for accelerating projectiles through such gas guns are described. More particularly, gas guns having a first injection port located proximate a breech end of a barrel and a second injection port located longitudinally between the first injection port and a muzzle end of the barrel are described. Additionally, modular gas guns that include a plurality of modules are described, wherein each module may include a barrel segment having one or more longitudinally spaced injection ports. Also, methods of accelerating a projectile through a gas gun, such as injecting a first pressurized gas into a barrel through a first injection port to accelerate the projectile and propel the projectile down the barrel past a second injection port and injecting a second pressurized gas into the barrel through the second injection port after passage of the projectile and to further accelerate the projectile are described.

23 Claims, 3 Drawing Sheets

SEQUENTIAL INJECTION GAS GUNS FOR ACCELERATING PROJECTILES

GOVERNMENT RIGHTS

This invention was made with government support under Contract No. DE-AC07-05-ID-14517 awarded by the United States Department of Energy. The government has certain rights in the invention.

TECHNICAL FIELD

The present invention relates to sequential injection gas guns and methods for accelerating projectiles through such gas guns. More particularly, embodiments of the invention relate to gas guns having a first injection port located proximate a breech end of a barrel and a second injection port located longitudinally between the first injection port and a muzzle end of the barrel. Embodiments of the invention also relate to modular gas guns that include a plurality of modules, wherein each module may include a barrel segment having one or more injection ports. Additional embodiments of the invention include methods of accelerating a projectile through a gas gun, such as injecting a first pressurized gas into a barrel through a first injection port to accelerate the projectile and propel the projectile down the barrel past a second injection port and injecting a second pressurized gas into the barrel through the second injection port to further accelerate the projectile.

BACKGROUND

The current state of the art of gas guns involves the compression of a propellant gas, usually a light-gas, such as helium, prior to introduction thereof into the gun chamber. Because all propellant gas is introduced through the rear of the gun chamber at the breech end of the gas gun, relatively high gas temperatures and peak pressures must be developed to accelerate a projectile to high velocities. This is because the initial gas pressure decreases rapidly and cannot be maintained as the projectile travels down barrel. As such, compression of the propellant gas generally requires the use of an explosive material, such as gun powder, acting on a piston.

When using conventional gas guns, the shot is not controlled beyond the initiation of a primary stage and if an undesirable projectile acceleration is occurring within the gun barrel it cannot be corrected during the shot. As a consequence, obtaining a desired projectile velocity generally involves trial and error.

In view of the above, it would be advantageous to provide improved gas gun devices and methods for accelerating projectiles. For example, it would be advantageous to provide gas gun devices and methods offering the acceleration of projectiles to desired high velocities at lower peak gas pressures and temperatures. Additionally, it would be advantageous to provide gas gun devices and methods that offer the ability to control the acceleration of a projectile as the projectile is accelerated.

SUMMARY OF THE INVENTION

In one embodiment, a gas gun comprises a barrel having a bore. The gas gun having at least one injection port in communication with the bore, located proximate a breech end of the barrel and in communication with a first pressure vessel through a first valve. The gas gun additionally having at least another injection port in communication with the bore, located longitudinally between the breech end and a muzzle end of the barrel and in communication with a second pressure vessel through a second valve.

In another embodiment, a modular gas gun comprises a plurality of modules. Each module comprises a barrel segment having a bore and at least one injection port in communication with the bore and a pressure vessel through a valve. Additionally, the barrel segment of each module of the plurality of modules is configured to connect to the barrel segment of at least one other module of the plurality of modules.

In an additional embodiment, a method of accelerating a projectile through a gas gun comprises positioning a projectile longitudinally between an injection port and another injection port within the bore of the barrel. A first pressurized gas volume is injected into the bore through the first injection port to accelerate the projectile and propel the projectile down the barrel past the second injection port. Additionally, a second pressurized gas volume is injected into the barrel through the second injection port after passage of the projectile thereby to further accelerate the projectile and propel the projectile down the barrel toward a muzzle end of the barrel.

DETAILED DESCRIPTION OF THE INVENTION

Figure 1:
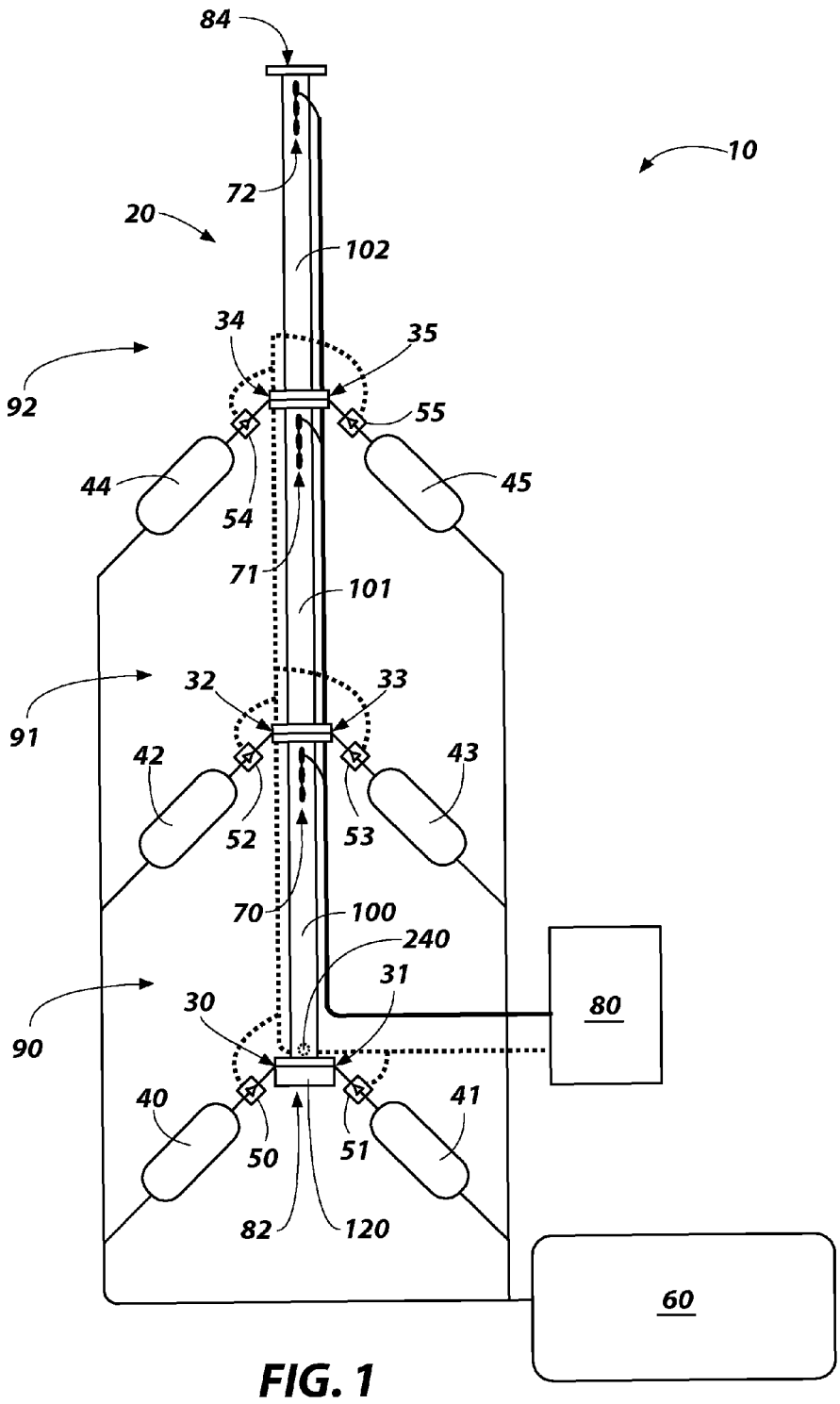
FIG. 1 shows a schematic view of a gas gun according to an embodiment of the present invention.

A gas gun 10 is shown in FIG. 1 that includes a barrel 20 with a bore having a plurality of injection ports 30-35 opening thereinto, each injection port, designated variously at 30-35 in respective fluid communication with a source of pressurized gas such as a pressure vessel, designated variously at 40-45 through an associated valve, designated variously at 50-55. The gas gun 10 may additionally include a primary pressure supply 60 in selective communication with and to charge pressure vessels 40-45, one or more projectile velocity sensors 70-72 and a control module 80.

Figure 2:
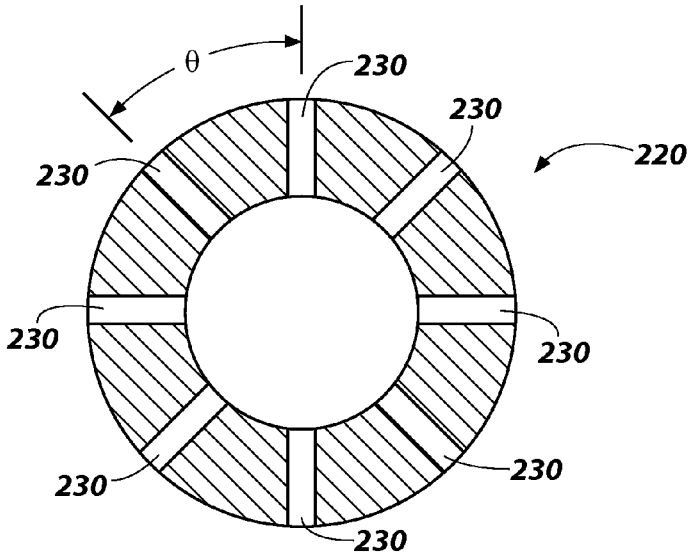
FIG. 2 shows a cross-sectional view of a barrel of a gas gun according to an embodiment of the present invention.

The barrel 20 includes a breech end 82, where a projectile may be positioned in preparation for launching, and a muzzle end 84, where the projectile may exit the barrel 20 upon launching. The barrel 20, having a plurality of injection ports 30-35, includes a first injection port 30 and a second injection port 32. The first injection port 30 is located at, or at least proximate to, the breech end 82 of the barrel and in fluid communication with a first pressure vessel 40 through a first valve 50 and the second injection port 32 is located longitudinally between the breech end 82 and the muzzle end 84 of the barrel 20 and in fluid communication with a second pressure vessel 42 through a second valve 52. Additionally, the first injection port 30 may be one of a first plurality of injection ports 30-31, each of the first plurality of injection ports 30-31 located at, or at least proximate, the breech end 82 of the barrel 20. Likewise, the second injection port 32 may be one of a second plurality of injection ports 32-33, each of the second plurality of injection ports 32-33 at a longitudinal location between the first plurality of injection ports 30-31 and the muzzle end 84 of the barrel 20. The barrel 20 may also include any number of additional injection ports 30-35 along its length, such as a third injection port 34 or a third plurality of injection ports 34-35 at a longitudinal location between the second plurality of injection ports 32-33 and the muzzle end 84 of the barrel 20, and so on. As shown in a cross-sectional view in FIG. 2, a plurality of injection ports 230 may be positioned at a given longitudinal location in a barrel 220 and may be arranged to form an annular array of injection ports 230, such that each injection port 230 of the plurality of injection ports 230 is located at the same longitudinal position and at circumferential intervals θ in the barrel 220. As depicted, interval θ is 45°, but the invention is not so limited, and a greater or lesser number of injection ports 230 than the eight shown in FIG. 2.

Referring again to FIG. 1, a plurality of projectile velocity sensors 70-72 may be distributed along the length of the barrel 20. A first projectile velocity sensor 70 may be located between the first injection port 30 and the second injection port 32, a second projectile velocity sensor 71 may be located between the second injection port 32 and the third injection port 34, and so on. A final projectile velocity sensor, which may be a third projectile velocity sensor 72, as shown, may be located proximate the muzzle end 84 of the barrel 20. The term "projectile velocity sensor," as used herein, means any sensor that provides a signal that may be used to determine at least one of: the position of the projectile in the barrel 20, the time that the projectile is at a known position in the barrel 20, the velocity of the projectile at a known position in the barrel 20, and the acceleration of the projectile at a known position in the barrel 20. Examples of projectile velocity sensors 70-72 include but are not limited to proximity sensors, hall effect proximity sensors, contact sensors, pressure transducers and optical sensors.

The gas gun 10 may include a control module 80 electronically coupled to, or otherwise in communication with, each projectile velocity sensor 70-72 and each valve 50-55 of the gas gun 10. For example, the control module 80 may be configured to receive signals from each projectile velocity sensor 70-72 and send signals to each valve 50-55.

As noted above, the gas gun 10 may also include a primary pressure supply 60 in selective communication with each pressure vessel 40-45 of the gas gun 10 to provide a pressurized gas to each pressure vessel 40-45. For example, each pressure vessel 40-45 may be a pressure accumulator fluidly coupled to the primary pressure supply 60, which in turn may be a vessel containing a stored compressed gas, a gas compressor, such as an air compressor, or a combination thereof. The pressurized gas may be one of, or a combination of, a number of gases, including but not limited to air, carbon dioxide, helium, hydrogen, nitrogen, oxygen and argon.

Figure 3:
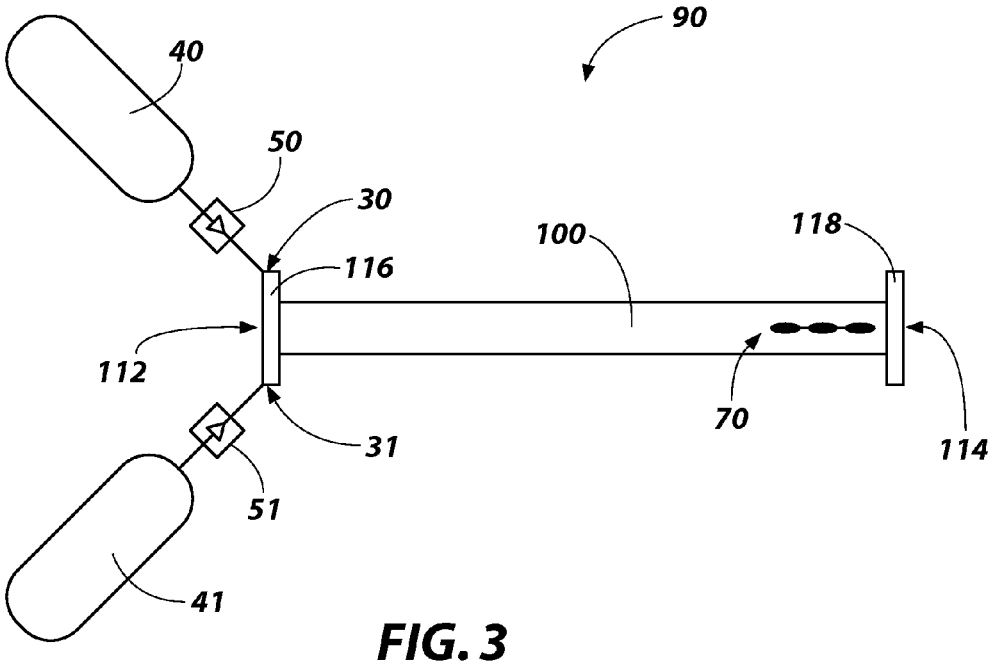
FIG. 3 shows a schematic view of a module of the gas gun shown in FIG. 1.

The gas gun 10 may be a multi-stage gas gun, as shown in FIG. 1, comprising a plurality of modules designated at 90-92 (a single module 90 shown in FIG. 3). As such, the barrel 20 of the gas gun may be configured as a multi-stage barrel, including a plurality of discrete barrel segments 100-102, wherein each module 90-92 includes one of the plurality of barrel segments 100-102. Each module 90-92 may be substantially identical, and a single module 90 is described in more detail with reference to FIG. 3.

With regard to FIG. 3, the barrel segment 100 of module 90 may have a breech end 112 and a muzzle end 114. The barrel segment may further include a coupler 116 at the breech end 112 and a coupler 118 at the muzzle end 114. The coupler 118 at the muzzle end 114 of the barrel segment 100 may be configured to mate with a coupler 116 at the breech end 112 of another barrel segment. For example, each barrel segment 100-102 may be configured as a metal pipe having a pipe flange at each end. With reference to FIG. 1, as to how the modules 90-92 may be arranged and mutually coupled, the breech end 112 of a first barrel segment 100 may be coupled to an end cap 120 to form the breech end 82 of the barrel 20 and a muzzle end 114 of the first barrel segment 100 may be coupled to the breech end 82 of the second barrel segment 101. The muzzle end of the second barrel segment 101 may be coupled to the breech end of a third barrel segment 102, and so on. The muzzle end of the final barrel segment, which is the third barrel segment 102 as shown, remains open to form the muzzle end 84 of the barrel 20.

Referring again to FIG. 3, the barrel segment 100 may have a plurality of injection ports 30-31, located at, or at least proximate, the breech end 112 of the barrel segment 100. Additionally, the barrel segment 100 may have a projectile velocity sensor 70 located at, or proximate, its muzzle end 114 or at any other desired location where its sensing function will not be compromised by gas injection.

The module 90 may further include a plurality of valves 50-51 and a plurality of pressure vessels 40-41. Each injection port 30-31 of the module 90 in fluid communication with the barrel segment 100 and respectively with a pressure vessel 40-41 through an associated valve 50-51. As such, each module 90-92 may be a complete gas gun unit that may be used individually, as a single-stage gas gun, or in combination with additional modules 90-92, as a multi-stage gas gun.

As each module 90-92 may be substantially identical, the gas gun 10 may be assembled with any number of modules 90-92. This may provide flexibility in the use of the gas gun 10, and allow the assembly of a gas gun 10 with the precise number of stages required for a particular application. Additionally, a modular construction may reduce the manufacturing cost of the gas gun 10 and facilitate efficient and convenient maintenance and repair of the gas gun 10. Modules 90-92 may be removed and replaced in a rotation so that service may be performed on a module 90-92 with minimal down-time of the gas gun 10.

Referring again to FIG. 1, a projectile 240 may be accelerated through the gas gun 10 by a method that comprises the sequential injection of pressurized gases into the barrel 20. The projectile 240 may be positioned longitudinally between the first plurality of injection ports 30-31 and the second plurality of injection ports 32-33 within the barrel 20, as shown in FIG. 1. A first pressurized gas volume may be injected into the barrel 20 through the first plurality of injection ports 30-31 to accelerate the projectile 240 and propel the projectile 240 down the barrel 20 past the second plurality of injection ports 32-33. Then, a second pressurized gas volume may be injected into the barrel 20 through the second plurality of injection ports 32-33 to further accelerate the projectile 240 and propel the projectile 240 down the barrel 20 toward the muzzle end 84 of the barrel 20. The gas injection process may be repeated as the projectile 240 advances through each module 90-92 of the gas gun 10.

Because the pressurized gas is injected into the gas gun 10 sequentially, the acceleration and velocity of the projectile 240 may be controlled as the projectile 240 travels down the barrel 20, as the amount of gas injected at an injection port 32-35 subsequent to, or downstream from, injection ports 30-31, may be adjusted based on data gathered during the shot.

In one embodiment, the gas gun 10 may be prepared by supplying a first pressurized gas volume to the first plurality of pressure vessels 40-41, a second pressurized gas volume to the second plurality of pressure vessels 42-43 and a third pressurized gas volume to the third plurality of pressure vessels 44-45 from a primary pressurized gas supply 60. By way of non-limiting example, a pressurized gas may be supplied from a primary pressure vessel containing the pressurized gas, or pressurized air may be supplied from a gas compressor, such as an air compressor.

A desired exit velocity for the projectile 240 may be predetermined prior to firing and the predetermined exit velocity may be input into the control module 80. The control module 80 may include a micro-processor which is programmed to calculate a value representing an ideal amount of pressurized gas to be injected at each module 90-92, which may also be termed a "stage" of the gas gun 10, and a value representing an ideal velocity for the projectile 240 at each of one or more longitudinal positions within the barrel 20 to achieve the predetermined exit velocity. The control module 80 may then be used to control the operation of the gas gun 10 in terms of timing and duration of gas injection through the valves 50-55. The control module 80 may cause a signal, such as an electrical voltage, to be sent to the first plurality of valves 50-51 causing the first plurality of valves 50-51 to open and cause the injection of the first pressurized gas to be directed from the first plurality of pressure vessels 40-41 into the barrel 20 through the first plurality of valves 50-51 and first plurality of injection ports 30-31. For example, each valve 50-51 may be a solenoid injector valve, such as the type used for fuel injection in internal combustion engines, and the signal may cause a solenoid of each valve 50-51 to operate and cause the first plurality of valves 50-51 to open for a specified time.

The injection of the first pressurized gas behind the projectile 240 (between the projectile 240 and the breech end 82) will cause a gas pressure behind the projectile 240 to exceed the gas pressure in front of the projectile 240, since the barrel 20 is open to the muzzle end 84, thus causing the projectile 240 to accelerate down the barrel 20 toward the muzzle end 84 and past first projectile velocity sensor 70. The first projectile velocity sensor 70, responsive to detection of the projectile 240 moving therepast, may send a data signal to the control module 80 as the projectile 240 travels through the barrel 20 at a longitudinal position in the barrel 20 prior to reaching the second plurality of injection ports 32-33. The signal from the first projectile velocity sensor 70 may be used by the microprocessor to calculate a value that represents the actual velocity of the projectile 240 at the longitudinal position, which may then be compared to the value that represents the ideal velocity for the projectile 240 at that longitudinal position. This comparison may be used to determine a new value representing the timing and amount of pressurized gas to be injected through the second plurality of injection ports 32-33. The control module 80 may then send a signal to the second plurality of valves 52-53 based on the new value to cause the second plurality of valves 52-53 to open at a particular time for a specified amount of time and cause the injection of the second pressurized gas volume to be directed from the second plurality of pressure vessels 42-43 into the barrel 20 through the second plurality of valves 52-53 and second plurality of injection ports 32-33. The injection of the second pressurized gas volume behind the projectile 240 will cause a second increase in gas pressure behind the projectile 240 and further accelerate the projectile 240 toward the muzzle end 84 of the barrel 20. These acts may be further repeated at each module 90-92 or stage of the gas gun 10, such that the acceleration and velocity of the projectile 240 may be controlled as it travels through the barrel 20 based on a feedback loop comprising signals received by the control module 80 from each projectile velocity sensor 70-72 and signals sent from the control module 80 to each valve 50-55.

In addition to controlling the acceleration and velocity of the projectile 240 as it travels through the barrel 20, embodiments of the method of the invention may be used to reduce peak gas pressures, which may be harmful to payloads. Peak gas pressures may be reduced because the pressurized gas is injected in stages, instead of injected only through the breech end 82 of the barrel 20. Reducing the peak pressure may enable the acceleration of relatively fragile projectiles in the gas gun 10, which projectiles would be damaged by relatively high peak pressures.

Another benefit of embodiments of the invention may be the realization of higher projectile velocities. The speed of a pressure wave in a working fluid, such as a pressurized gas in a gas gun 10, is limited to the speed of sound in the working fluid. Consequently, a pressure wave originating at the breech end of a conventional gas gun may not travel down the barrel to a location as quickly as pressurized gas may be directly injected at that same location in accordance with embodiments of the invention. Thus, each location of gas injection can be used to boost projectile acceleration at a faster rate than would otherwise be possible with only a single injection site proximate the breech end of a single stage gas gun.

Sequential injection methods may also enable the use of gases supporting a relatively low speed of sound. This capability may allow the use of readily available gases that support relatively low speeds of sound, such as air and carbon dioxide, to obtain projectile velocities that conventionally require the use of gases that support relatively high speeds of sound, such as helium and hydrogen.

In additional embodiments of the invention, sequential injection methods may be used with combustion gases, or other chemical reactants.

Figure 4:
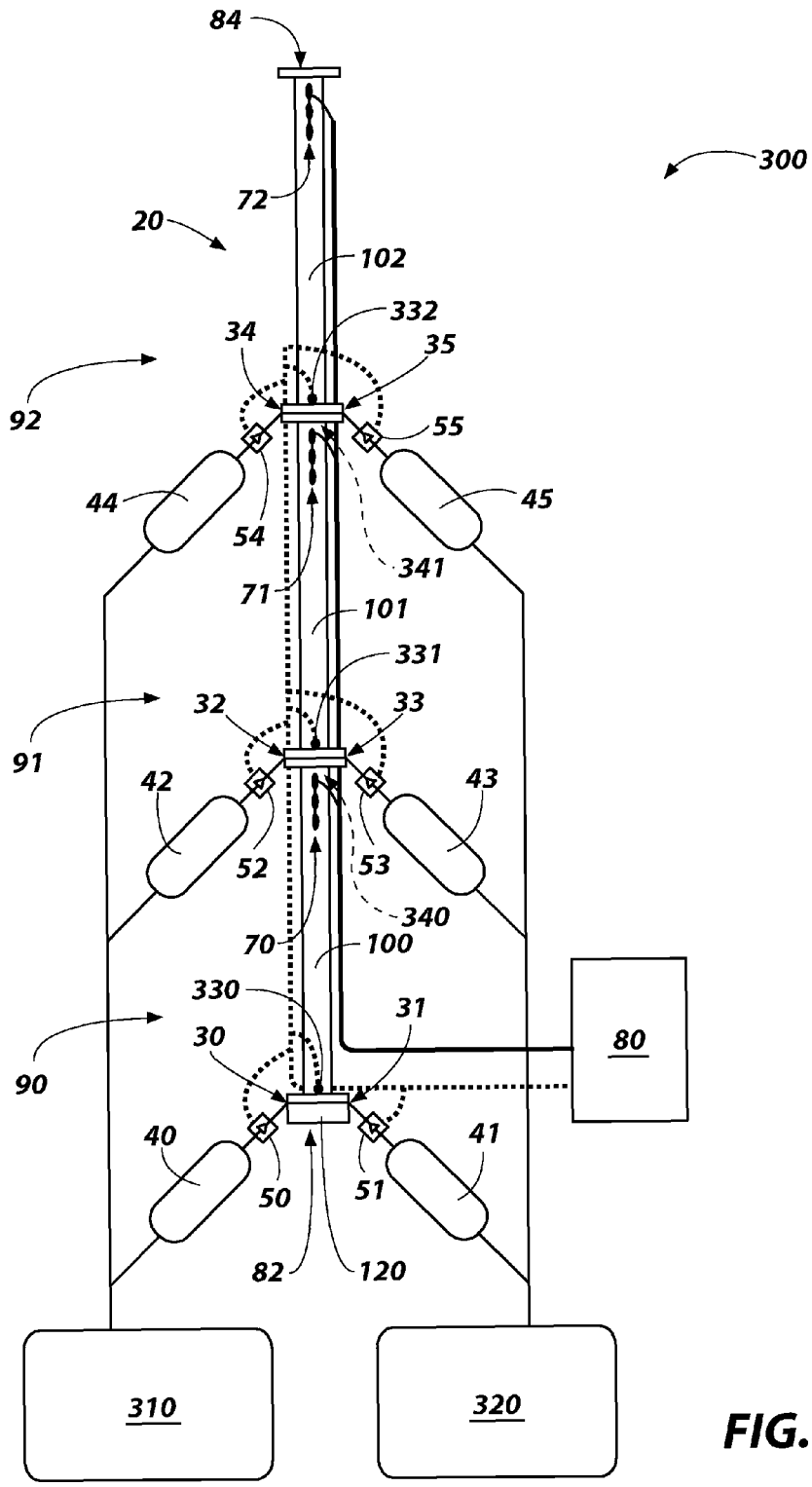
FIG. 4 shows a schematic view of another gas gun according to an additional embodiment of the invention.

An additional embodiment of a gas gun 300 according to the present invention is shown in FIG. 4. The gas gun 300 shown in FIG. 4 may be arranged in a manner similar to the gas gun 10 shown in FIG. 1. The gas gun 300 may include a barrel 20, proximity sensors 70-72 and a control module 80, similar to the gas gun 10 of FIG. 1. However, the gas gun 300 differs from the gas gun 10 somewhat in its configuration, as the gas gun 300 includes both a primary pressure supply 310 and a reactant supply 320. The inclusion of a separate primary pressure supply 310 and reactant supply 320 allow the introduction of a pressurized gas and a reactant that may combust, or react chemically, within each stage of the gas gun 300. The gas gun 300 may also include a first igniter 330, located proximate the first plurality of injection ports, and additionally include a second igniter 331 and a third igniter 332 located proximate the second and third plurality of injection ports 32-33 and 34-35 respectively, each igniter 330-332 in communication with the bore of the barrel 20. For example, the igniters 330-332 may be electronic igniters, such as spark plugs or piezoelectric igniters, which may form an electric arc within the bore to initiate a chemical reaction therein. Optionally, a plurality of igniters may be provided proximate each plurality of injection ports 30-35.

Optionally, the gas gun 300 may include one or more bore closure valves 340-341 located along the length of the barrel. For example, a first bore closure valve 340 may be located proximate the muzzle end 114 of the first barrel segment 100. Additional bore closure valves, such as a second bore closure valve 341, may be similarly situated in other barrel segments, such as the barrel segment 101.

The primary pressure supply 310 of the gas gun 300 may supply a pressurized gas to one or more pressure vessels at each stage of the gas gun 300, such as pressure vessel 40 of the first plurality of pressure vessels 40-41, pressure vessel 42 of the second plurality of pressure vessels 42-43, and pressure vessel 44 of the third plurality of pressure vessels 44-45. Additionally, the reactant supply 320 may provide a reactant, such as a reactant gas, to one or more pressure vessels at each stage of the gas gun 300, such as pressure vessel 41 of the first plurality of pressure vessels 40-41, pressure vessel 43 of the second plurality of pressure vessels 42-43, and pressure vessel 45 of the third plurality of pressure vessels 44-45.

In additional embodiments, the reactant supply may deliver a liquid reactant directly to reactant valves, such as valves 52, 53 and 55, through injection lines. For example, a liquid reactant may be delivered from a pump and/or pressure vessel to valves 52, 53 and 55 through an injection line and atomized within the bore of the barrel 20 as it is injected through one of the valves 52, 53 and 55.

The primary pressure supply 310 may supply a pressurized gas that may react chemically with a reactant. For example, the primary pressure supply 310 may supply an oxidizer, such as air, oxygen, nitrous oxide, or a combination thereof. The reactant supply 320 may supply a gas and/or a liquid that may, under appropriate stimulus, such as the aforementioned electrical arc, be caused to react with the pressurized gas supplied by the primary pressure supply 310. For example, the reactant supply 320 may supply a combustible gas, such as one or more of methane, propane, butane and acetylene. In another example, the reactant supply 320 may supply a combustible liquid, such as one or more of gasoline, kerosene, methanol and ethanol. In additional embodiments, the reactant supply 320 may supply a solid particulate reactant suspended in a gas or a liquid.

A projectile may be accelerated through the gas gun 300 by a method that comprises injections of a pressurized gas and a reactant into the barrel 20, and the initiation of a chemical reaction of the pressurized gas and reactant, such as combustion. The projectile may be positioned longitudinally between the first plurality of injection ports 30-31 and the second plurality of injection ports 32-33 within the barrel 20. A first pressurized gas volume may be injected into the barrel 20 through at least one injection port of the first plurality of injection ports 30-31, such as injection port 30, and a first reactant quantity may be injected through at least another injection port of the first plurality of injection ports 30-31, such as injection port 31. A chemical reaction of the first pressurized gas volume and first reactant quantity may be initiated by the first igniter 330, which will cause an increase in pressure behind the projectile to accelerate the projectile and propel the projectile down the barrel 20 past the second plurality of injection ports 32-33. Then, a second pressurized gas volume may be injected into the barrel 20 through at least one injection port of the second plurality of injection ports 32-33, such as injection port 32, and a second reactant quantity may be injected through at least another injection port of the second plurality of injection ports 32-33, such as injection port 33. A chemical reaction of the second pressurized gas volume and second reactant quantity may be initiated by the second igniter 331, which will cause another increase in pressure behind the projectile to further accelerate the projectile and propel the projectile down the barrel 20 toward the muzzle end 84 of the barrel 20. The gas/reactant injection and ignition process may be repeated as the projectile advances through each module 90-92 of the gas gun 300.

In additional embodiments, one or more igniters, such as the first igniter 330, may be used to initiate an initial chemical reaction, and subsequently injected pressurized gas volumes and reactant quantities may be caused to react by the flame front or reaction heat provided by the initial and/or subsequent chemical reaction without the assistance of additional igniters, such as igniters 331-332.

In yet additional embodiments, a relatively reactive pressurized gas volume and reactant quantity may be cooperatively formulated to react spontaneously upon mixing within the barrel 20 and may not require an igniter 330-332 to initiate a chemical reaction.

Because the pressurized gas volumes and reactant quantities are both injected into the gas gun 300 and caused to react at sequential stages, the acceleration and velocity of the projectile may be controlled as the projectile travels down the barrel 20, as the amount of gas and/or reactant injected at an injection port 32-35 subsequent to, or downstream from, injection ports 30-31, may be adjusted based on data gathered during the shot.

The control module 80 may control the operation of the gas gun 300, shown in FIG. 4, in a similar manner as discussed with reference to gas gun 10, shown in FIG. 1. The control module may control the operation of the valves 50-55 based on a predetermined velocity and feedback received from the projectile velocity sensors 70-72. However, in addition to controlling the timing and duration of a pressurized gas injection through valves 50, 52 and 54, the module may control the timing and quantity of a reactant injection through valves 51, 53 and 55. Additionally, the control module 80 may control the timing of the operation of one or more igniters 330-332.

As mentioned above, embodiments of the invention may include optional bore closure valves 340-341, as shown in FIG. 4, and may operate using sequential pressurized gas volume injections, as described in reference to the gas gun 10 shown in FIG. 1, or injections of pressurized gas volumes and reactant quantities, as described in reference to the gas gun 300 of FIG. 4. The bore closure valves 340-341 may be located at various locations along the barrel 20, as previously described, and may be configured to allow the passage of the projectile past the bore closure valve 340-341 when open, and block or restrict gas flow past the bore closure valve 340-341 when closed. For example, the closure valves 340-341 may include a ball type valve and/or a gate type valve.

Initially the bore closure valves 340-341 may be open and allow passage of the projectile as it is accelerated through the barrel 20. Substantially immediately after the projectile has passed the first bore closure valve 340, the first bore closure valve 340 may be closed. For example, the control module 80 may cause the first bore valve 340 to close by via an electromechanical actuator that may include a solenoid and/or a motor. The closure of the first bore valve 340 may be initiated by a sensor 70-72 upstream or downstream thereof which senses passage of a projectile, and be used to reduce the open bore volume behind the projectile to facilitate an increase in pressure behind the projectile caused by the injection through the second plurality of injection ports 32-33, and optionally a subsequent chemical reaction. After the projectile proceeds down the barrel 20 past the second bore closure valve 341, the second bore closure valve 341 may be caused to close, and so on.

In light of the above disclosure it will be appreciated that the devices and methods depicted and described herein enable the effective acceleration of projectiles to a specified velocity for experimental and laboratory use. In addition, it is contemplated that the invention may have additional utility in a variety of scales for a variety of other applications, such as military and aerospace applications. For example, the described devices and methods may be useful for launching projectiles in the form of warheads, missiles, munitions or other military ordnance. Additionally, the described devices and methods may be useful for launching aircraft, spacecraft, satellites or other devices into the atmosphere, into a planetary-orbit, or into outer space.

While specific embodiments of the invention have been shown by way of example in the drawings and have been described in detail herein, the invention is not limited to the particular forms disclosed. Rather, the invention includes all modifications, equivalents, and alternatives falling within the scope of the invention as defined by the following appended claims and their legal equivalents.

The invention claimed is:

1. A gas gun for firing a projectile, the gas gun comprising:

a barrel having a bore;

at least one gas injection port in communication with the bore, located proximate a breech end of the barrel and in communication with a pressure vessel through a first valve;

at least another gas injection port in communication with the bore, located longitudinally between the at least one injection port and a muzzle end of the barrel and in communication with at least another pressure vessel through a second valve;

a projectile velocity sensor located between the at least one gas injection port and the at least another gas injection port; and a control module in communication with the first valve, the projectile velocity sensor and the second valve, the control module comprising a processor configured for control of timing and duration of opening of the first valve and of the second valve and to determine a timing and duration of opening of the second valve responsive to a signal from the projectile velocity sensor.

2. The gas gun of claim 1, wherein:

the at least one gas injection port comprises a first plurality of gas injection ports; and the at least another gas injection port comprises a second plurality of gas injection ports.

3. The gas gun of claim 1, further comprising:

at least one reactant injection port located proximate a breech end of the barrel and selectively couplable to a reactant supply through a first reactant valve; and at least another reactant injection port located longitudinally between the at least one injection port and a muzzle end of the barrel and selectively couplable to a reactant supply through a second reactant valve.

4. The gas gun of claim 3, further comprising:

at least one igniter positioned proximate the at least one gas injection port and the at least one reactant injection port, and in communication with the bore.

5. The gas gun of claim 3, further comprising:

at least one igniter positioned proximate the at least one gas injection port and the at least one reactant injection port and at least another igniter positioned proximate the at least another gas injection port and the at least another reactant injection port, and in communication with the bore.

6. The gas gun of claim 1, further comprising at least one bore closure valve located longitudinally between the breech end and the muzzle end of the barrel.

7. The gas gun of claim 1, wherein the barrel comprises a multi-stage barrel, comprising:

a first discrete barrel segment; and a second discrete barrel segment longitudinally adjacent to the first discrete barrel segment;

wherein each barrel segment has at least one gas injection port and a valve associated therewith.

8. The gas gun of claim 7, wherein:

the first discrete barrel segment further comprises the at least one reactant injection port selectively couplable to a reactant supply through a first reactant valve; and the second discrete barrel segment comprises the at least another reactant injection port selectively couplable to a reactant supply through a second reactant valve.

9. The gas gun of claim 7, wherein:

the first discrete barrel segment comprises the projectile velocity sensor; and the second discrete barrel segment comprises another projectile velocity sensor.

10. The gas gun of claim 9, wherein:

the at least one gas injection port is located proximate a breech end of the first discrete barrel segment;

the projectile velocity sensor of the first discrete barrel segment is located proximate a muzzle end of the first discrete barrel segment;

the at least another gas injection port is located at a breech end of the second discrete barrel segment;

the another projectile velocity sensor of the second discrete barrel segment is located proximate a muzzle end of the second discrete barrel segment; and the muzzle end of the first discrete barrel segment is coupled to the breech end of the second discrete barrel segment.

11. The gas gun of claim 1, further comprising a primary pressure supply selectively couplable to the first pressure vessel and the at least another pressure vessel.

12. The gas gun of claim 6, further comprising:

a sensor associated with the at least one bore closure valve for sensing passage of a projectile through the bore in proximity to the sensor;

wherein the processor is configured to actuate the at least one bore closure valve responsive to a signal from the sensor upon sensing passage of a projectile.

13. A modular gas gun for firing a projectile, the modular gas gun comprising:

a plurality of longitudinally adjacent modules, each module comprising:

at least one pressure vessel for containing a pressurized gas;

a barrel segment having a bore;

at least one injection port positioned and configured for selective fluid communication with the bore of the barrel segment and the pressure vessel through a valve; and a projectile velocity sensor located proximate a muzzle end of the barrel segment;

wherein the barrel segment of each module of the plurality of modules connected longitudinally to the barrel segment of at least another module of the plurality of modules and a control module comprising a processor configured to selectively open each valve and to process signals from the projectile velocity sensor of each module.

14. The modular gas gun of claim 13, wherein each module further comprises:

at least another injection port positioned and configured for selective fluid communication with the bore of the barrel segment and a reactant supply through a reactant valve.

15. The modular gas gun of claim 14, wherein each module further comprises:

at least one igniter positioned proximate the at least one injection port and the at least another injection port and in communication with the bore.

16. The modular gas gun of claim 13, further comprising a bore closure valve located proximate a muzzle end of the bore of the barrel segment from which a fired projectile would exit.

17. The modular gas gun of claim 13, wherein the at least one injection port of each module of the plurality of modules further comprises a plurality of injection ports, the valve comprises a plurality of valves, each valve of the plurality of valves being associated with an injection port of the plurality of injection ports, and the at least one pressure vessel of each module comprises a plurality of pressure vessels, each pressure vessel associated with at least one valve of the plurality of valves.

18. The modular gas gun of claim 17, wherein each injection port of the plurality of injection ports of each module is located at a breech end of the barrel segment thereof.

19. The modular gas gun of claim 17, further comprising a primary pressure supply in selective communication with each pressure vessel of the plurality of pressure vessels.

20. The modular gas gun of claim 13, wherein the processor is further configured for control of timing and duration of a pressurized gas injection through each valve and to determine a timing and duration for opening of a pressurized gas injection through the valve associated with a given barrel segment responsive to a signal from a projectile velocity sensor of another barrel segment connected longitudinally to a breech end of the given barrel segment.

21. The modular gas gun of claim 14, wherein the processor is further configured to selectively open each reactant valve.

22. The modular gas gun of claim 21, wherein the processor is further configured for control of timing and duration for opening of each valve and each reactant valve and to determine a timing and duration for opening pressurized gas injection of the valve and a timing and quantity of reactant injection through the reaction valve associated with a given barrel segment responsive to a signal from a projectile velocity sensor of another barrel segment connected longitudinally to a breech end of the given barrel segment.

23. The modular gas gun of claim 13, further comprising:

a bore closure valve in at least one of the barrel segments; and a sensor associated with the bore closure valve for sensing passage of a projectile through the bore of the barrel segment in proximity to the sensor;

wherein the processor is configured to actuate the bore closure valve responsive to a signal from the sensor upon sensing passage of a projectile.

* * * * *

UNITED STATES PATENT AND TRADEMARK OFFICE

CERTIFICATE OF CORRECTION

PATENT NO. : 8,056,462 B1
APPLICATION NO. : 12/269972
DATED : November 15, 2011
INVENTOR(S) : Jeffrey M. Lacey et al.

It is certified that error appears in the above-identified patent and that said Letters Patent is hereby corrected as shown below:

In the claims:

| | | | |
|---|---|---|---|
| CLAIM 1, | COLUMN 9, | LINE 16, | change “injection port” to --gas injection port-- |
| CLAIM 7, | COLUMN 9, | LINE 62, | change “each barrel” to --each discrete barrel-- |
| CLAIM 8, | COLUMN 9, | LINE 65, | change “comprises the at” to --comprises at-- |
| CLAIM 8, | COLUMN 10, | LINE 1, | change “comprises the at” to --comprises at-- |
| CLAIM 11, | COLUMN 10, | LINE 24, | change “the first pressure” to --the pressure-- |
| CLAIM 13, | COLUMN 10, | LINE 42, | change “the pressure” to --the at least one pressure-- |

Signed and Sealed this
Twenty-fourth Day of September, 2013

Teresa Stanek Rea
*Deputy Director of the United States Patent and Trademark Office*